US006105182A

United States Patent [19]

Elnar

[11] Patent Number: 6,105,182

[45] Date of Patent: Aug. 22, 2000

[54] ADJUSTABLE, SPA MASSAGER MOUNTING ASSEMBLY

[76] Inventor: Joseph G. Elnar, 40142 Ravenwood Dr., Murrieta, Calif. 92562

[21] Appl. No.: 09/379,232

[22] Filed: Aug. 23, 1999

[51] Int. Cl.[7] ..... A47K 3/00

[52] U.S. Cl. ..... 4/541.1; 4/541.4; 4/541.6; 248/125.3; 248/295.11

[58] Field of Search ..... 4/541.1, 541.2, 4/541.3, 541.4, 541.5, 541.6, 559, 575.1; 248/125.3, 222.11, 222.13, 224.7, 224.15, 295.11, 220.21, 220.22, 220.41, 220.42, 220.43, 297.21, 297.31, 274.1; 403/83, 104, 107, 108, 331, 341, 380; 211/90.01, 162, FOR 106, FOR 107, 26, 26.1, 89.01, 208

[56] References Cited

U.S. PATENT DOCUMENTS

| | | | |
|---|---|---|---|
| 1,254,993 | 1/1918 | Desiardins | 135/69 |
| 3,078,484 | 2/1963 | Briggs | 248/222.11 |
| 4,375,934 | 3/1983 | Elliott | 248/108 |
| 4,436,269 | 3/1984 | Dirksing et al. | 248/297.21 |
| 4,509,741 | 4/1985 | Smith | 272/69 |
| 4,660,885 | 4/1987 | Suhr et al. | 248/429 |
| 5,597,288 | 1/1997 | Hatanaka | 4/429 |

*Primary Examiner*—Henry J. Recla
*Assistant Examiner*—Khoa D. Huynh
*Attorney, Agent, or Firm*—Edgar W. Averill, Jr.

[57] ABSTRACT

An adjustable, spa massager mounting assembly for use in hydrotherapy hot tubs or whirlpool baths. The mounting assembly includes a first member secured to a hot tub and a second member joined to a spa massaging unit. The first member has a track portion along which a slider portion of the second member captively and matingly slides. The first and second members are capable of releasably securing to each other at a desired relative position by means of a slide-lock component on one of the members. The slide-lock component has an engaging portion which is adapted to releasably engage at least one indentation of a plurality of indentations on the other one of the members. Additionally, in one preferred embodiment a cantilever arm of the slide-lock component maintains the engaging portion in resilient contact with the plurality of indentations during movement of the first and second members relative to each other and when a desired position is reached.

7 Claims, 5 Drawing Sheets

ADJUSTABLE, SPA MASSAGER MOUNTING ASSEMBLY

BACKGROUND OF THE INVENTION

The field of the invention generally pertains to adjustable mounts. The invention relates more particularly to an adjustable, spa massager mounting assembly for use in hydrotherapy hot tubs or whirlpool baths.

Various types of spa massagers have been utilized in hydrotherapy hot tubs or whirlpool baths to therapeutically enhance the bathing experience. They do so by soothing and relaxing sore, stiff muscles, and by relieving tension and stress around the neck, shoulder, and back areas typically incurred during the work day or week. In this manner spa massagers help promote health and well-being while one enjoys the relaxing atmosphere afforded by a hydrotherapy hot tub or whirlpool bath.

However, a feature arguably as important as the spa massager itself is the spa massagers ability to adjust to various heights for reaching various target areas of the body where relief is desired. Where a spa massager is fixed in one preset position, however, these target areas cannot be reached. Additionally, a fixed position prevents different sized individuals from comfortably using the spa massager, and can greatly detract from the spa massaging and bathing experience.

While various adjustable mounts have been used to raise or lower spa massagers to reach a greater area of the neck, shoulders, and back, they typically involve complicated adjustment methods which are prohibitively difficult to adjust, or which require substantial effort on the part of the user.

For example, in U.S. Pat. No. 5,682,625, an adjustable headrest for a spa tub is shown with water jets positioned on the headrest to direct jets of water onto the neck, head or upper shoulders. The headrest also includes an adjustment device which includes first and second guide rails used to position the headrest at various heights. The first and second guide rails each have a C-shaped cross section with a vertical slot used to guide upper and lower projections of the headrest between a plurality of notches on the C-shaped cross section.

One problem with the adjustment device in the '625 patent, however, is that it requires the user to properly align the upper and lower projections on each side of the headrest to the corresponding notches on the first and second guide rails. Because the upper and lower projections connecting at the first guide rail can move independent of the upper and lower projections at the second guide rail, adjustment will always be subject to improper alignment. Thus even minor height adjustments can be severely inconvenient and frustrating.

Additionally, in an alternate embodiment of the first and second guide rails, the upper and lower projections must manually be snap-fitted into selected notches. Thus a three-fold effort is required for any adjustment: first, pulling the upper and lower projections out from their originally positioned notches, second, locating the proper notches corresponding to a desired height, and third, snap-fitting the projections into the proper corresponding notches. This also requires substantial effort on the part of the user.

Furthermore, separation of the headrest from the first and second guide rails requires the upper projection to be raised through the vertical slot and slid out through a horizontal slot, with the lower projections following suit in similar fashion. This can be sufficiently complicated to an average user when attempting to use the headrest independent and apart from its location on the hot tub. Thus the adjustment device disclosed in the '625 patent can substantially interfere in the enjoyment of the spa massager and the relaxing environment originally intended with such spa massagers.

BRIEF SUMMARY OF THE INVENTION

It is an object of the present invention to provide an adjustable, spa massager mounting assembly capable of adjusting the spa massager to various positions where it is possible to reach a greater area of the neck, shoulders, and back, as well as accommodate different sized individuals.

It is a further object of the present invention to provide a simple and easy-to-use spa massager mounting assembly which is easily adjustable by an average user with little effort.

It is a still further object of the present invention to provide a rigid and durable spa massager mounting assembly which is capable of withstanding repeated adjustments without failure or otherwise compromising its operation.

It is a still further object of the present invention to provide a spa massager mounting assembly capable of releasing the spa massager for hand-held operation.

It is a still further object of the present invention to provide a waterproof spa massager mounting assembly capable of functioning reliably both in and out of water.

The present invention is for an adjustable, spa massager mounting assembly for use in hydrotherapy hot tubs or whirlpool baths. The mounting assembly includes a first member mountable to a hydrotherapy hot tub having at least one track portion and a first slide surface. The mounting assembly also includes a second member fixedly secured to a spa massager having at least one slider portion and a second slide surface. The slider portion is adapted to captively and matingly slide on the corresponding track portion of the first member, with the second slide surface slidably contacting the first slide surface of the first member. The first and second members releasably secure to each other by means for releasably securing the first and second members at a desired position relative to each other. The means for releasably securing includes at least one plurality of indentations on the slide surface of one of the first and second members, and at least one slide-lock component fixedly secured to the other one of the first and second members. The plurality of indentations is linearly arranged parallel to the track portion, and the slide-lock component has an engaging portion adapted to releasably engage at least one indentation of the plurality of indentations at each desired position. The slide-lock also has engaging portion resiliencing means for maintaining the engaging portion in resilient contact with the plurality of indentations during movement of the first and second members relative to each other and when a desired position is reached.

DETAILED DESCRIPTION OF THE PREFERRED EMBODIMENTS

Figure 1:
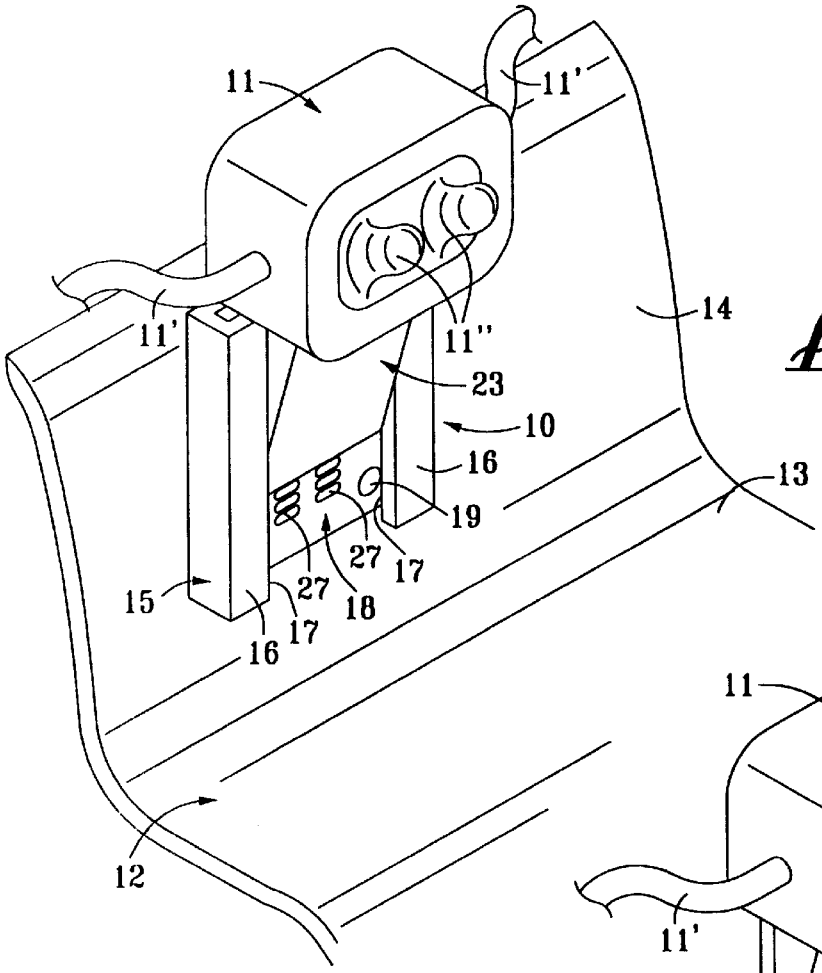
FIG. 1 is a perspective view of the adjustable, spa massager mounting assembly mounted to a hot tub.

Referring now to the drawings, FIG. 1 shows a perspective view of the adjustable, spa massager mounting assembly, generally indicated by reference character 10. The mounting assembly 10 functions to adjustably secure a spa massaging unit, generally indicated by reference character 11, to a hydrotherapy hot tub or whirlpool bath, generally indicated by reference character 12. As shown in FIGS. 1–10C, the spa massaging unit 11 is preferably a mechanical spa massaging unit 11 with moving or vibrating elements performing the massage. However, the mounting assembly may also be used to with spa massaging units employing jets of heated water as the massaging medium (not illustrated). The particular mechanical spa massaging unit 11 shown in FIGS. 1–10C utilizes hoses 11' to channel pumped water into the mechanical spa massage unit 11 which in turn mechanically drives rotating arms 11". And as shown in FIG. 1, the hydrotherapy hot tub 12 has a seating portion 13 and an integrally formed backrest portion 14 having a generally flat surface. The mounting assembly 10 is mounted to the backrest portion 14 of the hydrotherapy hot tub 12 so that an individual user may sit on the seating portion 13 and lean back against the spa massaging unit 11. Typically, the hydrotherapy hot tub 12, including the seating portion 13 and the backrest portion 14, has a fiberglass wall composition covered with an acrylic coating common in the hydrotherapy hot tub industry.

Figure 2:
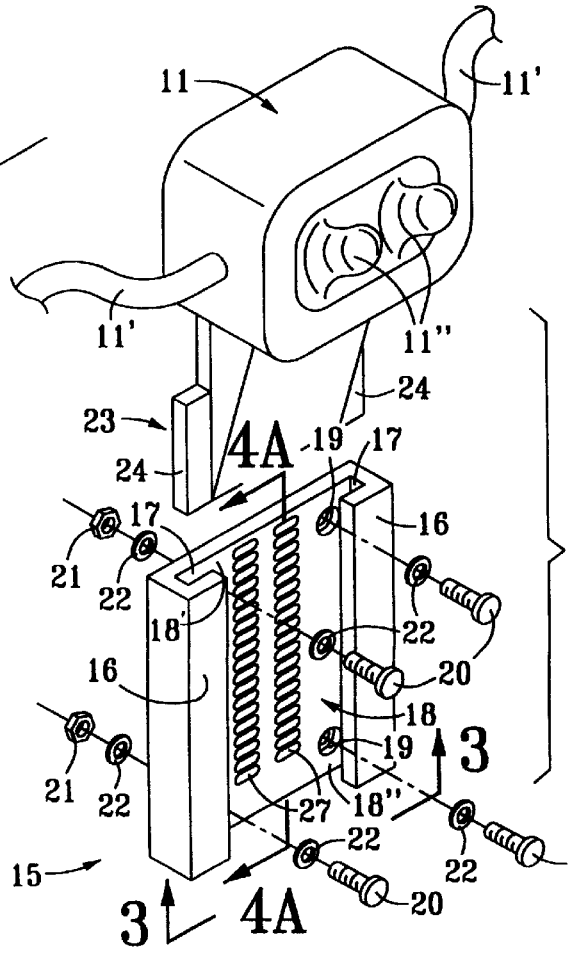
FIG. 2 is a perspective, exploded view of the adjustable, spa massager mounting assembly of FIG. 1.
Figure 3:
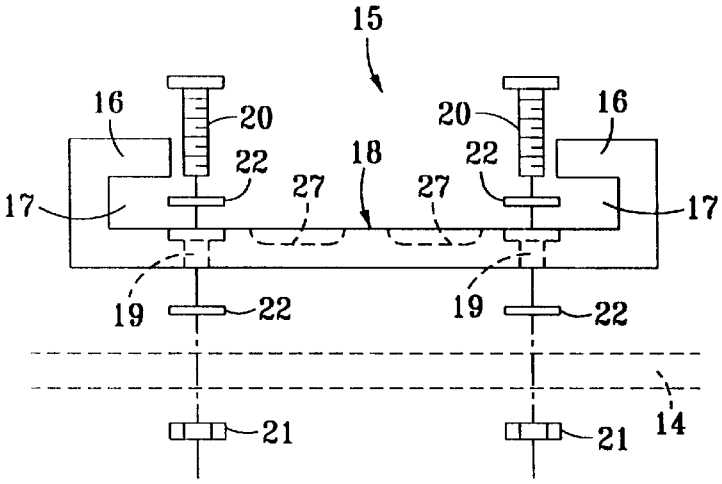
FIG. 3 is an end view of the first member taken along the line of 3—3 of FIG. 2.
Figure 4A:
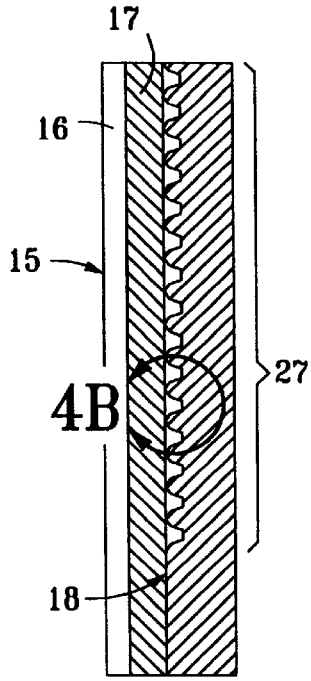
FIG. 4A is a cross-sectional view of the first member taken along the line of 4—4 of FIG. 2.
Figure 4B:
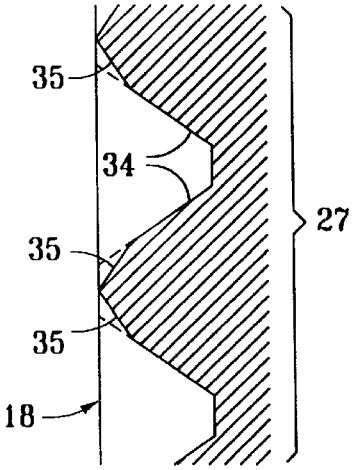
FIG. 4B is an enlarged cross-sectional view of the first member taken along the circle 4A of FIG. 4.
Figure 5:
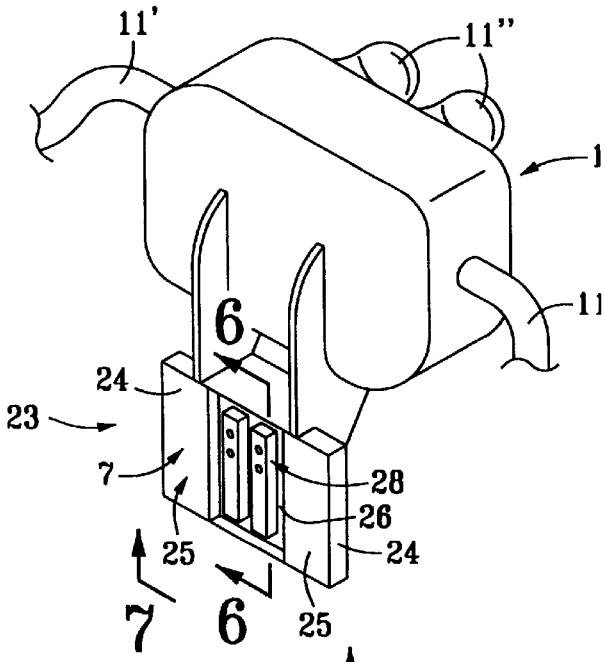
FIG. 5 is a perspective view of the second member as generally seen from the rear.
Figure 6:
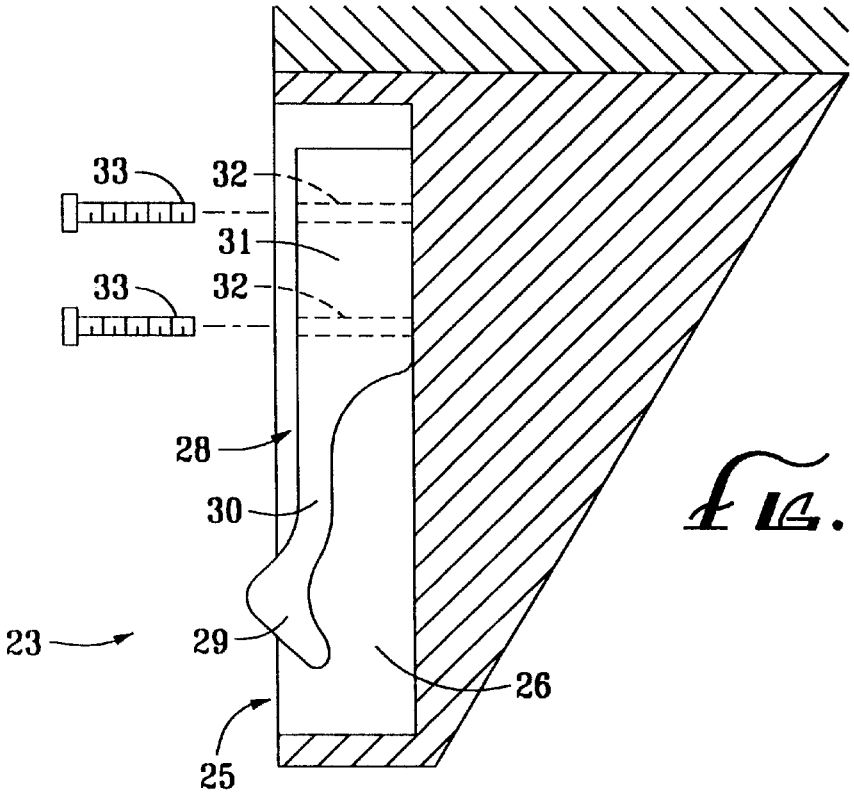
FIG. 6 is a cross-sectional view of the second member taken along the line of 6—6 of FIG. 5.
Figure 7:
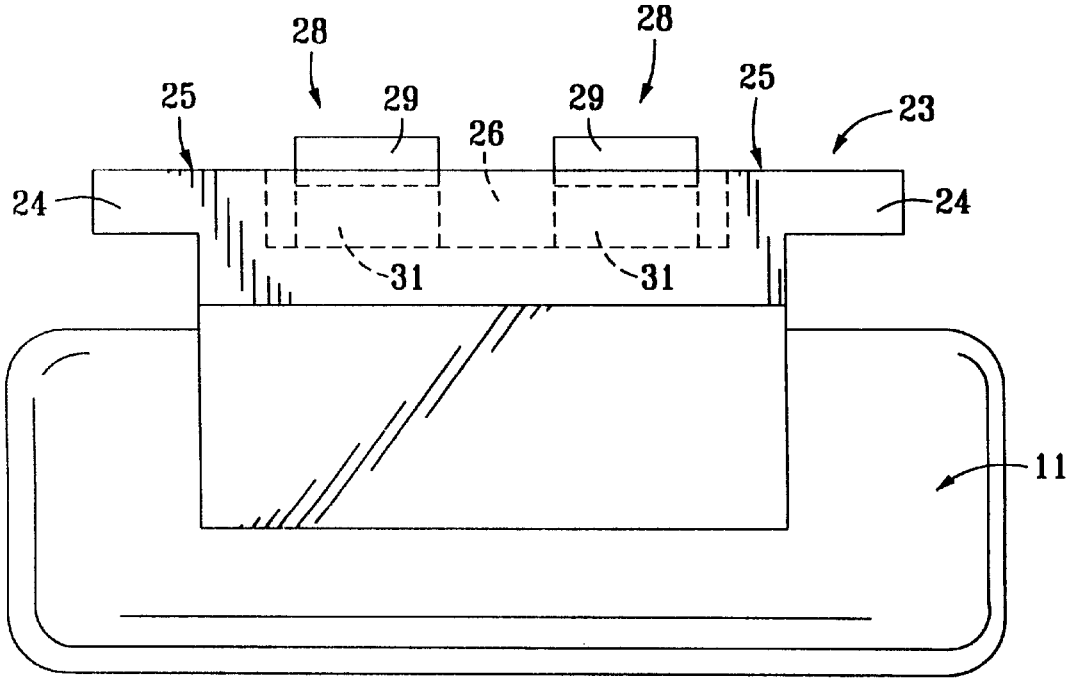
FIG. 7 is a bottom end view of the second member taken along the line of 7—7 of FIG. 5.

As can be best seen in FIG. 1 and the exploded perspective view in FIG. 2, the mounting assembly 10 comprises a first member, generally indicated by reference character 15, including at least one track portion 16 and a first slide surface 18. As shown in FIGS. 1–4, 8 and 9, the first member 15 preferably has one track portion 16 being a pair of parallel rails 16 joined to the first slide surface 18 and forming a pair of parallel channels 17. As shown in FIGS. 2 and 3, the first slide member 15 is fixedly secured to the backrest portion 14 of the hydrotherapy hot tub 12 by conventional threadedly fastening means, such as bolt 20 and nut 21 combinations. The bolts 20 extend through pre-drilled holes 19 on the first member 15 by entering from the first slide surface 18, and secure to nuts 21 on the opposite side of the backrest portion 14. When fully fastened, the head of each bolt 20 will preferably sit below the first slide surface 18 to prevent interfering with the first slide surfaces 18 sliding operation. Because the mounting assembly 10 is to be used both in and out of water, waterproofing seals are preferably employed, such as rubber O-rings 22 or silicone-based sealants.

As shown in FIGS. 1, 2, and 5–9, the mounting assembly 10 also includes a second member, generally indicated by reference character 23 which is fixedly secured to the spa massaging unit 11. The second member 23 includes at least one slider portion 24 adapted to captively and matingly slide on the corresponding track portion 16 of the first member 15, and a second slide surface 25 slidably contacting the first slide surface 18 of the first member 15 (See FIGS. 10A–C). The slider portion 24 is preferably a pair of parallel flanges 24 which mates with the pair of parallel channels 17 of the first member 15.

The mounting assembly 10 also includes means for releasably securing the first and second members 15, 23 at a desired position relative to each other. The means for releasably securing the first and second members 15, 23 comprises at least one plurality of indentations 27 on the slide surface 18, 25 of one of the first and second members 15, 23, and at least one slide-lock component 28 fixedly secured to the other one of the first and second members 15, 23. As shown in FIGS. 1–10C, one preferred embodiment is shown having two sets of the plurality of indentations 27 located on the first slide surface 18 of the first member 15 and linearly arranged parallel to the track portion 16 and to each other. Similarly, the preferred embodiment has two corresponding slide-lock components 28 fixedly secured to the second member 23 and oriented parallel to each other. Although one plurality of indentations 27 and one slide-lock component 28 would generally be sufficient for supporting most spa massaging units 11, two of each can provide greater reliability and durability, especially for heavier spa massaging units 11.

Details of the plurality of indentations 27 can be best seen in FIGS. 1–4B, 8 and 9. As shown in FIGS. 1–3, 8 and 9 each indentation preferably has an elongated shape which is longitudinally oriented normal to the track portion 16. Additionally, as can be best seen in FIGS. 4A–B, each indentation has a pair of opposing sidewalls 34 tapered to form a generally V-shaped configuration therebetween. Also, the indentation sidewalls 34 have chamfers 35 at the corresponding one of the first and second slide surfaces 18, 25 (18 in FIGS. 1–10C). The chamfers 35 allow easier adjustment of the second member 23 as will be discussed below in detail. In one preferred embodiment, the two sets of the plurality of indentations 27 are preferably located near an upper end 18' (FIGS. 2, 9, and 10A–C) of the first slide surface 18, thereby enabling the second member 23 to slide out and separate from the first member 15. This allows the spa massaging unit 11 to be used for hand-held operation provided the hoses 11' are sufficiently long. On the other hand, as best seen in FIG. 2, the two sets of the plurality of indentations 27 are spaced away from a lower end 18" of the first slide surface 18. This effectively prevents the second member 23 from slidably separating from the first member 15 at the lower end 18".

Details of the slide-lock component 28 can be best seen in FIGS. 5–7, and 10A–C. The slide-lock component 28 has an engaging portion 29 adapted to releasably engage at least one indentation of the plurality of indentations 27 at each desired position (See FIGS. 10A and 10C). And the slide-lock component 28 also has engaging portion resiliencing means 30 for maintaining the engaging portion 29 in resilient contact with the plurality of indentations 27 during movement of the first and second members 15, 23 relative to each other and when a desired position is reached. In a preferred embodiment, as shown in FIGS. 5–7, and 10A–C, the slide-lock component 28 has a "leaf spring" configuration with the engaging portion 29 being a leading end 29 of a cantilever arm 30 suspendedly extending from a base 31. The base 31 is fixedly secured to the other one of the first and second members 15, 23 (23 in FIGS. 1–10C) by conventional threaded fasteners, such as screws 33. In particular, as can be seen in FIGS. 6 and 10A–C, the base 31 is secured in a cavity 26 on the second slide surface 25 whereby only the leading end 29 protrudes beyond the second slide surface 25. Preferably, the screws 33 secure the base 31 in the cavity 26 of the second member 23 via pre-drilled holes 32 on the base 31. The cantilever arm's 30 rigidity returns the cantilever arm 30 back to its less biased state, and therefore effectively functions as the engaging portion resiliencing means 30.

Figure 8:
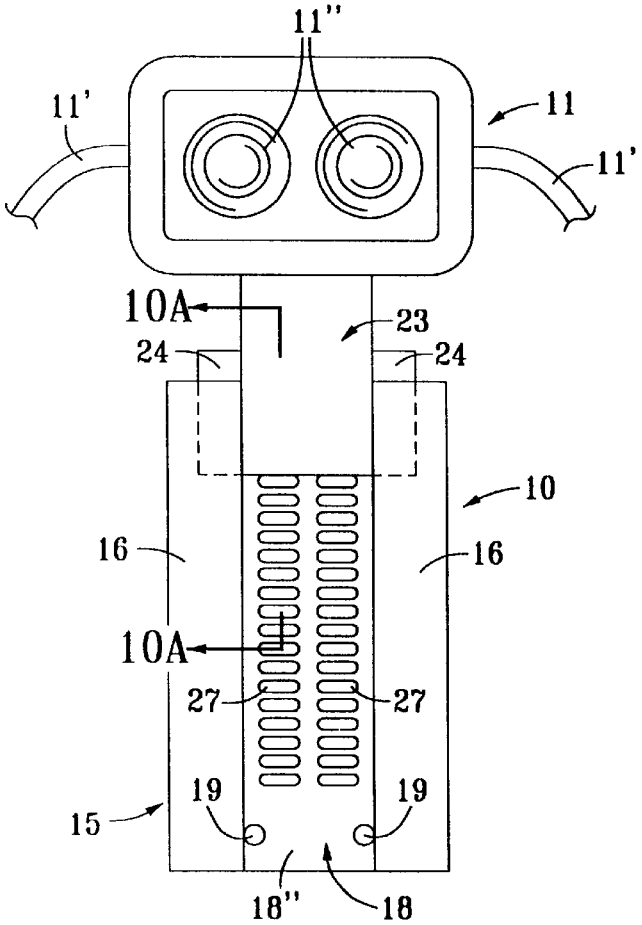
FIG. 8 is a front view of the adjustable, spa massager mounting assembly raised to a high elevation.
Figure 9:
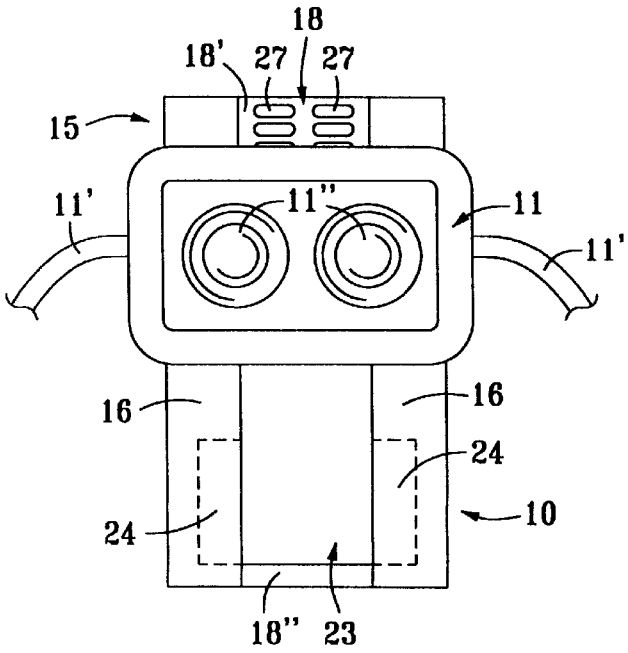
FIG. 9 is a front view of the adjustable, spa massager mounting assembly lowered to a low elevation.
Figure 10A:
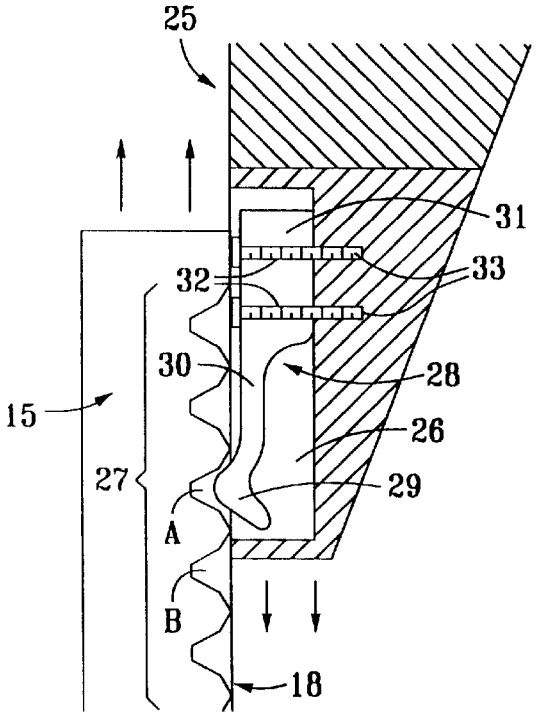
FIG. 10A is a cross-sectional view of the adjustable, spa massager mounting assembly taken along the line of 10A—10A in FIG. 8 illustrating the initial stage of a typical height adjustment between indentations.
Figure 10B:
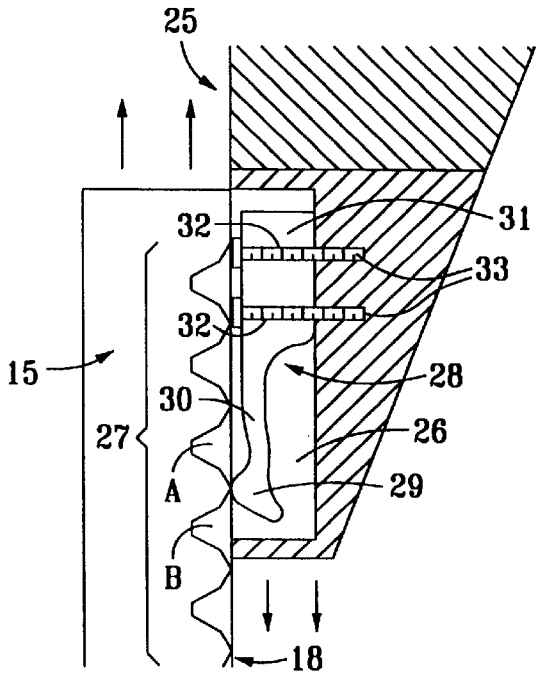
FIG. 10B is a cross-sectional view of the adjustable, spa massager mounting assembly following FIG. 10A illustrating the intermediate stage of a typical height adjustment between indentations.
Figure 10C:
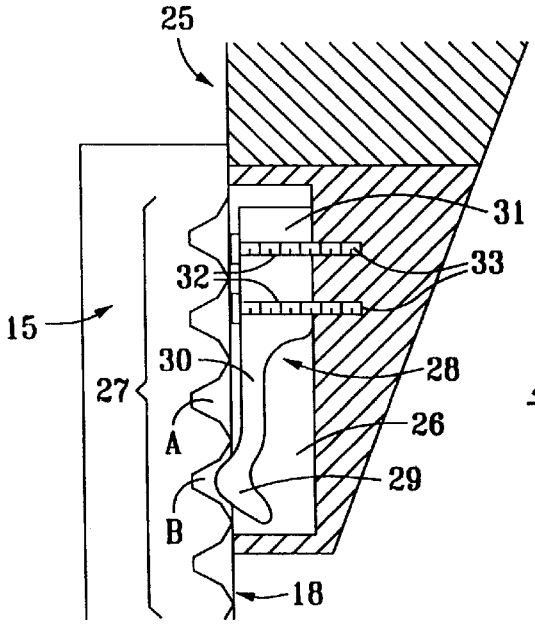
FIG. 10C is a cross-sectional view of the adjustable, spa massager mounting assembly following FIG. 10B illustrating the final stage of a typical height adjustment between indentations.

The operation of the mounting assembly 10 is illustrated in FIGS. 8–10C. In particular, FIGS. 10A–C illustrate the dynamic operation of the means for releasably securing the first and second members 15, 23 relative to each other as they slide against each other along the first and second slide surfaces 18, 25.

In FIG. 10A, the engaging portion 29, i.e. leading end 29, is shown engaging indentation A of the plurality of indentations 27. The leading end 29 is able to maintain its engaged position in the selected indentation A due to the resiliencing means afforded by the cantilever arm's 30 rigidity. Additionally, the rigidity of the cantilever arm 30 also provides the resiliencing means to maintain the leading end 29 in resilient contact with the plurality of indentations 27 during movement of the first and second members 15, 23 relative to each other. While a cantilever arm 30 is shown, the engaging portion 29 could alternatively be a captured ball biased by a helical spring pressing it as in a conventional detent mechanism.

FIG. 10B shows the transitional position of the leading end 29 between indentations A and B with the cantilever arm 30 flexed. Due to the generally V-shaped configuration of the indentations, oppositely directed forces on the first and second members 15, 23 will produce an upward deflection of the leading end 29 when the leading end 29 is moved between indentations A and B. Because of its high modulus of elasticity, however, the cantilever arm 30 will tend to resist deflection. Preferably, travel between indentations A and B can be made easier by chamfers 35 on the corresponding one of the first and second slide surfaces 18, 25 (18 in FIG. 10B). Chamfers 35 operate to slide the leading end 29 to the next indentation once the leading end 29 rises to the level of the chamfer 35. This allows easier movement between indentations where the indentation sidewalls 34 necessarily have a steep incline to prevent the leading end 29 from slipping between indentations. And finally, FIG. 10C illustrates the final stage of a typical height adjustment with the leading end 29 of the cantilever arm 30 engaged in indentation B.

In this manner, as shown in FIGS. 8 and 9, the first and second members 15, 23 are capable of sliding between a high position (FIG. 8) and a low position (FIG. 9). The range between the highest position and lowest position will depend in part on the height of the first 15 or second 23 member (15 in FIGS. 1–10C) having the plurality of indentations 27, as well as the position of the lowest indentation, e.g. the indentation nearest the lower end 18" of the first slide surface 18.

The composition of the structural components of the adjustable, spa massager mounting assembly 10, including the first and second members 15, 23, are composed of a suitable molded plastic material. Additionally, the slide-lock component 28 is preferably composed of a plastic material having a high modulus of elasticity yet having moderate resiliently-biasing characteristics.

As used herein and in the claims, the word "hydrotherapy hot tub" includes whirlpool baths. Further, the word "resiliencing" is defined and used herein and in the claims to mean "that which makes something resilient," Thus, "resiliencing means" is further defined to mean "the means by which something is made resilient or has a resilient quality," or "the enabling cause, factor, or source of a materials resilience." And still further, the word "leaf spring" is understood in the relevant art to mean a cantilever type method of applying a force to hold down an object.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An adjustable, spa massager mounting assembly for use in a hydrotherapy hot tub, said mounting assembly comprising:

a first member mountable to a hydrotherapy hot tub and including at least one track portion and a first slide surface;

a second member fixedly secured to a spa massager and including at least one slider portion adapted to captively and matingly slide on the corresponding track portion of said first member, and a second slide surface slidably contacting the first slide surface of said first member; and means for releasably securing said first and second members at a desired position relative to each other comprising:

at least one plurality of indentations on the slide surface of one of the first and second members, said plurality of indentations linearly arranged parallel to the track portion; and at least one slide-lock component fixedly secured to the other one of the first and second members, said slide-lock component having an engaging portion adapted to releasably engage at least one indentation of the plurality of indentations per desired position, and engaging portion resiliencing means for maintaining the engaging portion in resilient contact with the plurality of indentations during movement of the first and second members relative to each other and when a desired position is reached.

2. An adjustable, spa massager mounting assembly for use in a hydrotherapy hot tub as in claim 1, wherein said means for releasably securing said first and second members at a desired position relative to each other has two sets of the plurality of indentations and two corresponding slide-lock components.

3. An adjustable, spa massager mounting assembly for use in a hydrotherapy hot tub as in claim 1, wherein the slide-lock component has a leaf spring configuration with the engaging portion being a leading end of a cantilever arm suspendedly extending from a base fixedly secured to the other one of the first and second members, and the engaging portion resiliencing means being the cantilever arm.

4. An adjustable, spa massager mounting assembly for use in a hydrotherapy hot tub as in claim 1, wherein the first slide surface has upper and lower ends; and wherein the plurality of indentations is located on the first slide surface near the upper end enabling the second member to slidably separate from the first member at the upper end, and spaced from the lower end preventing the second member from slidably separating from the first member at the lower end.

5. An adjustable, spa massager mounting assembly for use in a hydrotherapy hot tub as in claim 1, wherein each indentation has an elongated shape which is longitudinally oriented normal to the track portion.

6. An adjustable, spa massager mounting assembly for use in a hydrotherapy hot tub as in claim 1, wherein each indentation includes a pair of opposing indentation sidewalls tapered to form a generally V-shaped configuration therebetween.

7. An adjustable, spa massager mounting assembly for use in a hydrotherapy hot tub as in claim 6, wherein the indentation sidewalls are chamfered at the corresponding one of the first and second slide surfaces.

* * * * *